US006708038B1

(12) United States Patent
Laguer-Diaz et al.

(10) Patent No.: US 6,708,038 B1
(45) Date of Patent: Mar. 16, 2004

(54) VEHICLE COMMUNICATIONS SYSTEM

(75) Inventors: Juan Laguer-Diaz, San Juan, PR (US); David Joseph Schroeck, Erie, PA (US)

(73) Assignee: General Electric Company, Schenectady, NY (US)

( * ) Notice: Subject to any disclaimer, the term of this patent is extended or adjusted under 35 U.S.C. 154(b) by 324 days.

(21) Appl. No.: 09/694,451

(22) Filed: Oct. 23, 2000

Related U.S. Application Data

(60) Provisional application No. 60/162,294, filed on Oct. 28, 1999.

(51) Int. Cl.[7] ..... H04Q 7/20

(52) U.S. Cl. ..... 455/462; 455/342; 455/456.1; 455/456.2; 455/456.3; 455/456.4; 455/445; 701/32; 701/29; 701/215; 701/300; 340/409; 340/433; 340/434; 340/435

(58) Field of Search ..... 455/342, 462, 455/456.1, 456.2, 456.3, 456.4, 456.5, 445; 342/375.07; 340/409, 433, 434, 435; 701/32, 29, 215, 300

(56) References Cited

U.S. PATENT DOCUMENTS 5,239,294 A * 8/1993 Flanders et al. ..... 340/5.74

OTHER PUBLICATIONS

Westinghouse Wireless Solutions Company; Interface Control Document (Series 1000), Mobile Satellite Telephone System, Control Port Users Guide; Released Oct. 26, 1995; 30 pages.

* cited by examiner

*Primary Examiner*—Dwayne Bost
*Assistant Examiner*—David Nguyen
(74) *Attorney, Agent, or Firm*—Carl A. Rowold; John L. DeAngelis, Jr.; Beusse Brownlee Wolter Mora & Maire, P.A.

(57) ABSTRACT

A locomotive communication system for communicating between a locomotive and a fixed site. A communication system commissioning process is utilized to ensure that the locomotive phone number and locomotive road number are paired at the fixed site so that data downloaded from the locomotive, in response to a call from the fixed site using the locomotive phone number will be identified with the correct locomotive road number.

9 Claims, 6 Drawing Sheets

VEHICLE COMMUNICATIONS SYSTEM

This patent application claims the benefit of the U.S. provisional application file on Oct. 28, 1999, and assigned application Ser. No. 60/162,294.

BACKGROUND OF THE INVENTION

The present invention is directed in general to communications systems for vehicles and more specifically, to a method and apparatus for establishing and controlling the communications between a vehicle and a remote site, e.g., a monitoring and diagnostic service center.

Establishing, maintaining and managing a communications link between a mobile asset (e.g., an on-road, off-road or rail-based vehicle) can provide opportunities for cost-saving operation through efficient vehicle dispatching and the remote acquisition of vehicle performance information. As applied to railroad operations, cost-efficiency requires minimization of locomotive down time and especially the avoidance of line-of-road locomotive failures. Failure of a major locomotive system can cause serious damage, require costly repairs, and introduce significant operational delays in the railroad transportation network. A line-of-road failure is an especially costly event as it requires dispatching a replacement locomotive to pull the train consist rendering a track segment unusable until the disabled train is removed. As a result, the health of the locomotive engine and its constituent subassemblies is of significant concern to the railroad operator.

In the past, there has been no automatic or systematic mechanism for locomotive fault detection. Instead, the railroad operator relies primarily on regular inspections and the observation of performance anomalies by the locomotive operator. Some cursory inspection processes are accomplished while the locomotive is in service. More thorough inspections require the locomotive to be taken out of service for several days. Any locomotive down time, whether for inspection or repair, represents a significant railroad cost that advantageously should be minimized. The same generic inspections processes are applied to off-road, on-road, and other rail-based vehicles.

One such apparatus for detecting faults and thereby hopefully minimizing locomotive down time is an on-board monitor that measures performance and faul-trelated operational parameters of the locomotive or other mobile asset during operation. Off-board analysis of this information can provide timely indications of actual and expected component failures. With timely and nearly continuous access to locomotive performance data, it is now possible for locomotive repair experts to predict and/or prevent untimely failures. The on-board monitor collects, aggregates and communicates locomotive performance and fault related data from an operating locomotive to a monitoring and diagnostic center. The data may be collected periodically or as required by various triggering events occurring during locomotive operation. Generally, anomalous or fault data is brought to the attention of the locomotive operator directly by the locomotive systems, but the locomotive itself lacks the necessary hardware and software devices to diagnose the fault. It is therefore, advantageous to utilize the on-board monitor to collect and aggregate the information and at the appropriate time, send the information to a monitoring and diagnostic service center. Upon receipt of the performance data at the monitoring and diagnostic service center, computer based data analysis tools analyze the data to identify the root cause of potential or actual faults. Also, experts in locomotive maintenance and operation analyze the received data to prepare recommendations for preventive maintenance or to correct existing faults or anomalous conditions.

BRIEF SUMMARY OF THE INVENTION

The present invention relates to an apparatus and method for commissioning the communications system installed on board an off-road, on-road or rail-based vehicle so that the vehicle number is associated with the unique communications identifier or telephone number assigned to the communications system installed on the vehicle. Once commissioned, the communications system can establish a link between the operating vehicle and a remote site for the purpose of transmitting fault, operational parametric and location information from the vehicle to the remote site and for uploading control information and instructions in the reverse direction.

The process of providing communications services to a remotely located vehicle requires the initialization, configuration and synchronization of several different systems and databases. The present invention establishes an automatic commissioning process for accomplishing these tasks.

The present invention further includes control system algorithms for handling specific communications events between the vehicle and the remote site. These algorithms provide a communications system that is more robust and reliable and less susceptible to fault.

BRIEF DESCRIPTION OF THE DRAWINGS

The present invention can be more easily understood and the further advantages and uses thereof more readily apparent, when considered in view of the description of the preferred embodiments below and the following figures, in which.

DETAILED DESCRIPTION OF THE PREFERRED EMBODIMENTS

Figure 1A:
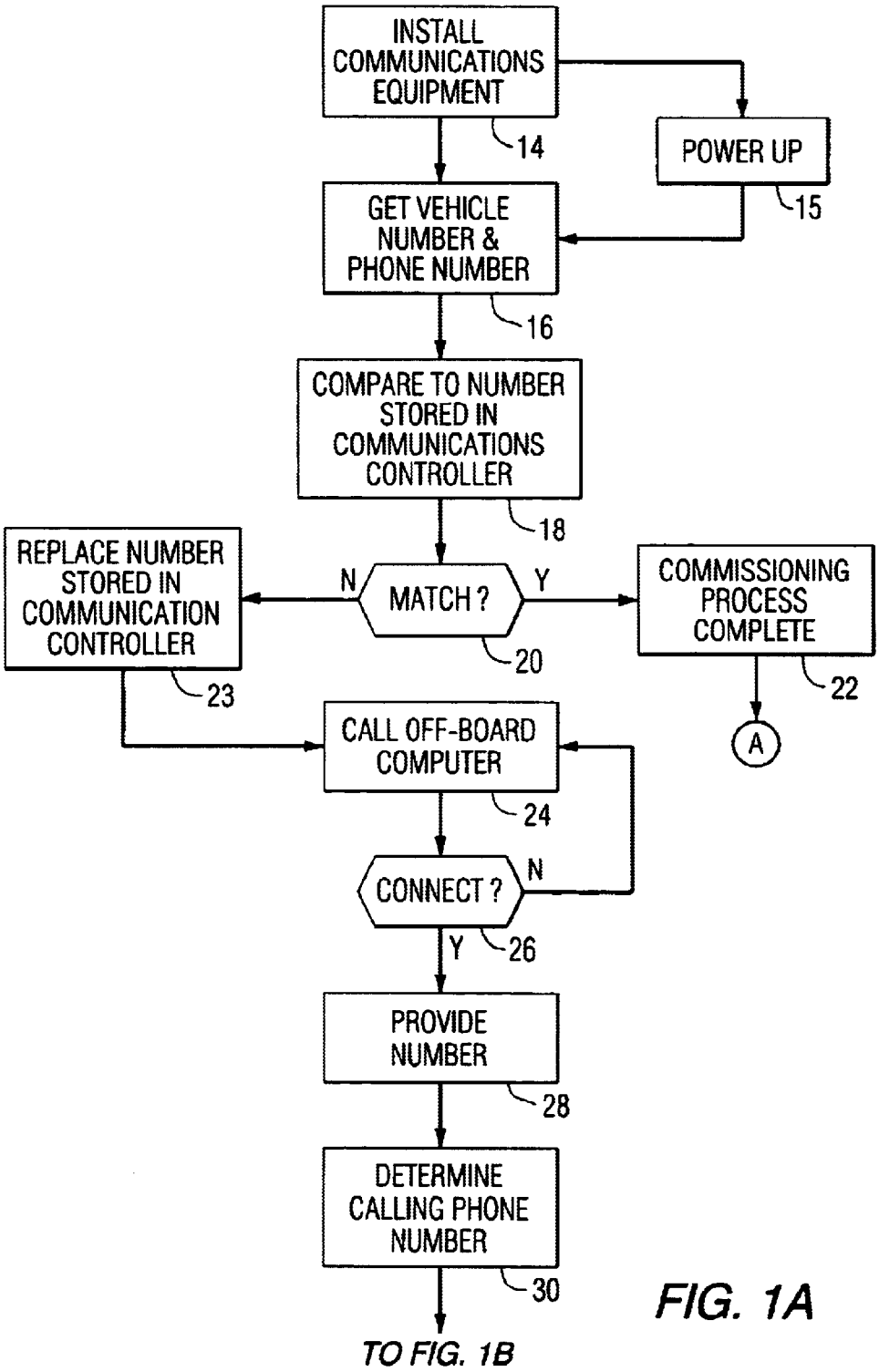
FIGS. 1A and 1B illustrate a flow chart depicting the communications commissioning process of the present invention.

Before describing in detail the particular vehicle communication system in accordance with the present invention, it should be observed that the present invention resides primarily in a novel combination of processing steps and hardware related to a vehicle communication system. Accordingly, these processing steps and hardware components have been represented by conventional processes in the drawings, showing only those specific details that are pertinent to the present invention so as not to obscure the disclosure with structural details that will be readily apparent to those skilled in the art having the benefit of the description herein.

The remote site can comprise a monitoring and diagnostic center (for monitoring and providing repair recommendations to vehicles within a fleet) a vehicle dispatching center or any other remote site that communicates regularly with the vehicle fleet for providing information to or collecting information from the fleet vehicles.

Figure 1B:
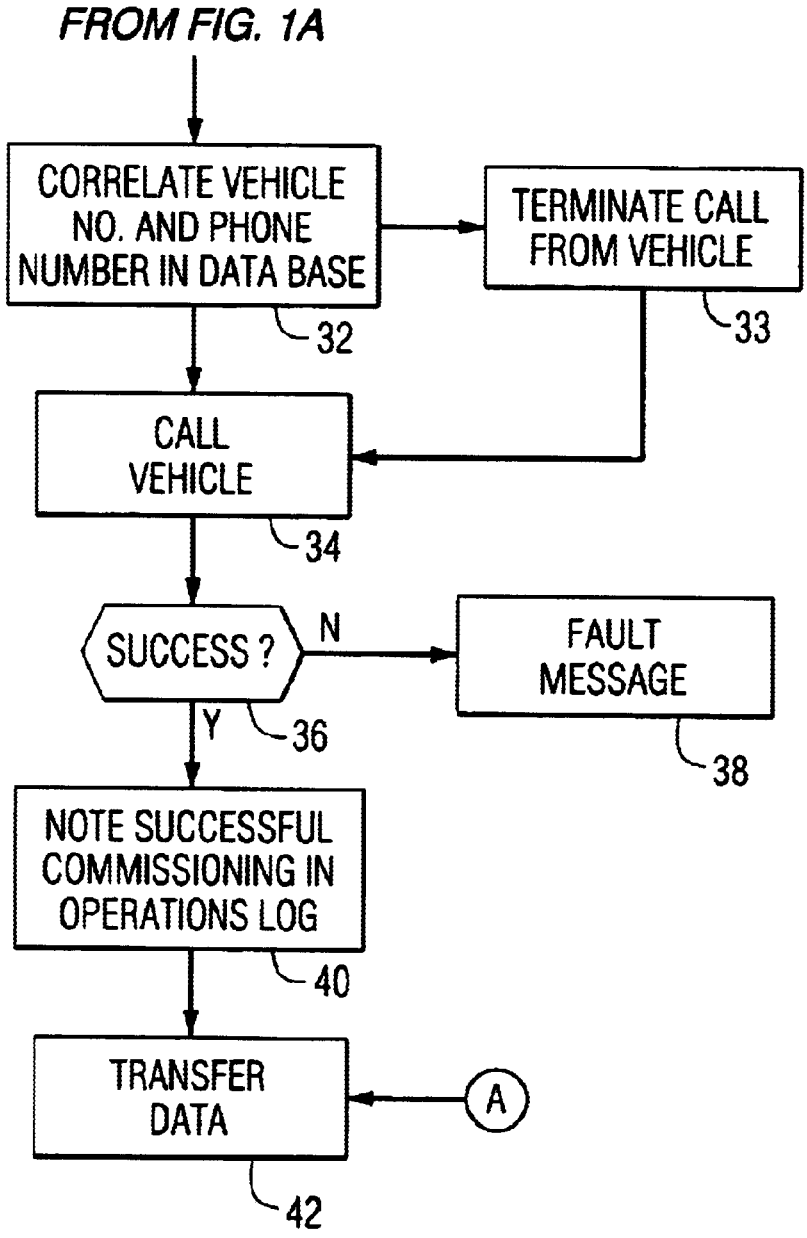

The process of commissioning the vehicle communication system is illustrated in FIGS. 1A and 1B. The commissioning process associates a unique vehicle number with the access or contact number assigned to the communications system aboard that vehicle. Therefore, data sent to or received from the communications system contact number will be matched to the correct vehicle. The mechanism for accessing or contacting the communications system on the vehicle is dependent on the communications system type. For instance, satellite-based or cellular-type systems employ a unique telephone number. A TCP/IP based system (transmission control protocol/internet protocol) employs a unique address or uniform resource locator. As used herein, the phrase "telephone number" or "phone number" is intended to apply to all types of communications systems where the called party has a unique communications system identifier, (comprised of numerals and/or characters) such as a cellular or personal communications system, a dedicated or private land line system, the public-switched telephone network, a satellite communications system or an Internet-based system where a universal resource locator serves as the "called party" identifier, such that the remote site can establish a communications link with a selected vehicle.

Once commissioned, the vehicle can establish a communications link with a remote computer, such as a computer at a remote site for in one embodiment, downloading information from the vehicle to the remote computer or for uploading information from the remote computer to the vehicle. Also, after commissioning the system, a remote computer can call a specific vehicle number by calling the telephone number associated (through the commissioning process) with that vehicle number. The algorithm of FIGS. 1A and 1B can be stored in and executed by a microprocessor in the communications system controller (to be discussed herein below) or by any of the microprocessors aboard a modern-day vehicle.

The communication system commissioning algorithm 10 begins at a step 14 when communications equipment is installed within a vehicle. When the equipment is then powered up at a step 15, the commissioning algorithm 10 starts processing. Note that when the communications system is subsequently powered up, processing begins at the step 15. At a step 16, the vehicle number is obtained from a storage location within the vehicle. As applied to locomotives, the locomotive road number is stored in the integrated function controller (IFC). The IFC, as is well known by those skilled in the art, is one of the primary vehicle control systems for controlling several locomotive subsystems. At a step 18, the retrieved vehicle number is compared with the number stored in the communications controller. In the event the communications system had been transferred from another vehicle, the vehicle number stored therein will be the number of the vehicle from which the equipment was taken. Or if the communications system is new, a dummy vehicle number, created when the system was built, will be stored in the communications controller. At the step 18 the vehicle number stored in the communications controller is compared to the retrieved number, and at a step 20 a determination is made whether the two numbers match. A match indicates that the communication system had been previously commissioned (see a step 22) and is now ready for transferring data between the vehicle and the remote computer at a step 42. As discussed above, in one embodiment, the remote computer at the remote site will receive parametric operational information and also data related to vehicle status, location, faults, anomalous conditions, etc. for the purpose of dispatching the vehicle, recommending repairs to correct faults or to avoid incipient vehicle failures.

The vehicle number check process is critical because it ensures that the phone number of the communications system controller is associated with the vehicle number in which the communications system is installed. Because information communicated to the remote computer at the remote site is identified by the calling phone number, it is imperative that the calling phone number is associated with the correct vehicle, as identified by vehicle number. In this way, data received from and identified by the calling phone number will be associated with the correct vehicle number. For example, a situation can arise where a communications system is removed from a first vehicle and installed in a second vehicle. Based on the calling telephone number (which is embedded in the communications system), the remote computer will associate calls from that calling phone number with the first vehicle number. The commissioning algorithm 10 avoids this problem by ensuring that the calling phone number and vehicle number are correctly associated before permitting communications with the remote computer.

If the two vehicle numbers do not match, at a step 23 the number in the communications controller is replaced with the number stored within the vehicle. At a step 24, the communications system calls the remote site. These calls utilize a satellite-based communications system, a cellular system, microwave links or other terrestrial satellite communications systems. The status of the connection between the vehicle communication system and the remote site is checked at a decision step 26. If a connection has not been successfully accomplished, then processing moves back to the step 24 to repeat the connection attempt.

Once the communications connection has been established, processing moves to a step 28 where the vehicle communication system provides the vehicle number to the remote site. The number provided is the number stored within the vehicle communication system controller at the step 23.

At a step 30, the remote site determines the phone number of the calling vehicle. The phone number can be obtained by a conventional caller identification processes or the communication system controller of the vehicle can provide the phone number digits directly to the remote computer at the remote site. The remote computer associates the received vehicle number and phone number at a step 32 and stores this information in a data base for later use. Then, each time the remote computer receives information from the vehicle, a comparison process is undertaken to ensure that the calling telephone number and the number of the calling vehicle match the calling number/vehicle number pair stored in the remote computer. If a mismatch is detected, this is an indication that the communication equipment may have been transferred to a different vehicle. In the embodiment where the remote site is at a monitoring and diagnostic service center, it is critical that the calling phone number and the vehicle number match the stored pair so that the downloaded parametric operational location, and fault information will be assigned to the correct vehicle. The only mechanism for accomplishing this accurately is through the use of the vehicle number matched to the calling telephone number.

Once the vehicle number and calling phone number have been correlated, the initial call from the vehicle to the remote computer is terminated at a step 33. At a step 34 the remote computer calls the vehicle, using the phone number determined at the step 30, to verify that the communications system is functioning properly. A decision step 36 determines the success of that call and creates a fault message at a step 38 if the call was not successful, indicating the system may not have been properly commissioned. The failure event is logged at the remote computer and at the on-board monitor of the vehicle. The call to the vehicle will be placed again at a later time.

If the call was successful, processing moves to a step 40 where the successful commissioning of the vehicle communications system is noted at the remote site and in the operations log maintained by the on-board monitor in the vehicle. Specifically, the telephone number/road number pair is activated at the remote site so that thereafter the telephone number/road number pair will be recognized as identifying a commissioned vehicle communication system. The operations log on the vehicle can be retrieved via a portable test unit (one example is a laptop computer) by a vehicle service technician to verify the operational status of the vehicle communications system.

As represented generally by a step 42, the remote computer then downloads operational information or location information from the vehicle. In the embodiment where the remote site is a monitoring and diagnostic service center, the data is used to evaluate the vehicle performance and develop necessary repair recommendations. The monitoring and diagnostic service system also uploads configuration information to the vehicle via the communications link. This configuration information configures the various systems and software applications on board the vehicle, including the onward monitor.

The ability of the vehicle communications system to automatically execute a self-commissioning process with the remote site is critical, given that the vehicle may be one member of a large vehicle fleet equipped with a communications system for communicating with the remote site. Also, it is likely that during its operational lifetime, new or upgraded vehicle communications systems will be installed in the vehicle. Therefore, it is advantageous to provide a reliable and cost effective process for commissioning and configuring the vehicle communications system at initial start-up.

Figure 2:
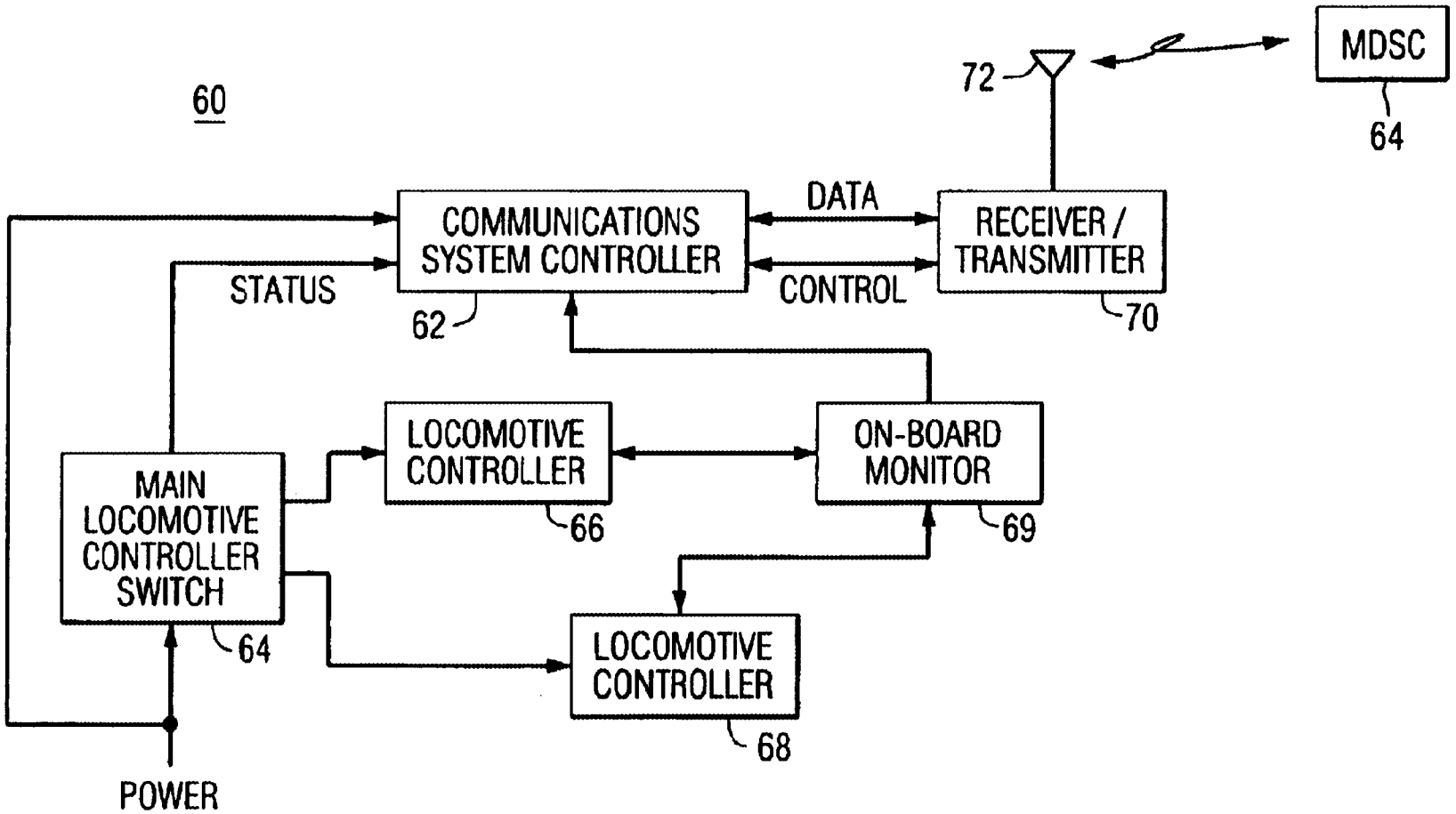
FIG. 2 is a block diagram of the communications system in accordance with the present invention.

FIG. 2 is a block diagram applying the teachings of the present invention to a locomotive communications systems 60. A communications system controller 62 executes a plurality of control algorithms (including the communications commissioning algorithm 10) to handle specific communication events. Parametric operational and fault information related to the locomotive communications system 60 is recorded in a locomotive operational log (not shown). Information from this log is sent periodically (or immediately for certain significant severe faults) to the monitoring and diagnostic service center (MDSC) 64, shown in FIG. 2. As discussed above in conjunction with the commissioning process, operational information and fault data is analyzed and repair recommendations are generated at the MDSC 64. FIG. 2 depicts the communications system controller system 62 as a separate element of the locomotive communications system 60. Those skilled in the art will recognize that in fact the functions performed by the communications systems controller 62 can instead be executed by another controller on board the locomotive.

Both the communications system controller 62 and a main locomotive controller switch 64 are fed power produced by the generator (or an alternative source), as driven by the diesel engine of the locomotive. The main locomotive controller switch 64 when closed, supplies power to other locomotive systems, including locomotive controllers 66 and 68. The locomotive controllers 66 and 68 can represent the integrated function controller mentioned above or the propulsion system controller for controlling the locomotive propulsion system, which transfer parametric data bidirectionally with the onward monitor 69. When the main locomotive switch 64 is open, no power is supplied to the locomotive controllers 66 and 68, but since the communications system controller 62 is not powered through the switch 64, it remains energized. A status signal representing the position of the main locomotive controller switch 64 is input to the communication system controller 62 as shown. In one embodiment of the present invention, the functionality of the communications system controller 62 is performed by the onward monitor 69. As shown, data is transferred between the communications system controller 62 and a receiver/transmitter 70, which is coupled to an antenna 72 for transmitting to and receiving RF signals from the MDSC 64. The communication system controller 62 is also connected to the receiver/transmitter 70 via a control link, as labeled in FIG. 2. The control link monitors and controls the receiver/transmitter 70.

Figure 3:
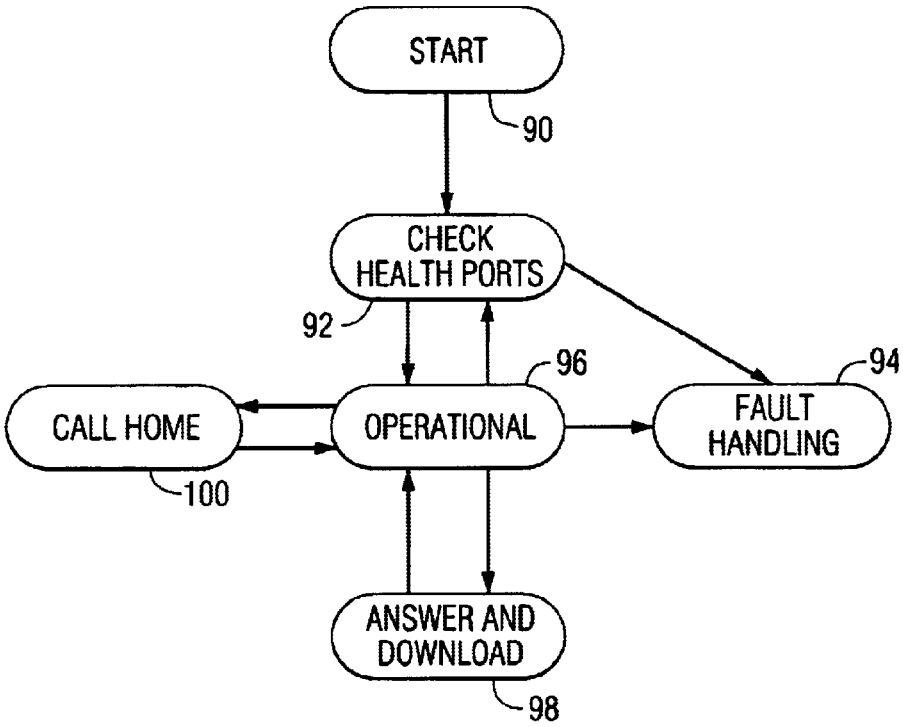
FIG. 3 is a state diagram illustrating operational status of the communications system of FIG. 2.

FIG. 3 is a system state diagram illustrating operation of the locomotive control system 60 and the other elements shown in FIG. 2. System startup is depicted by a state 90. This is the initial state of the locomotive communication system 60, which occurs whenever the on-board monitor is powered up. At a state 92, the locomotive communication system 60 determines the health of both the data and control connection between the communication system controller system 62 and the receiver/transmitter 70. See FIG. 2. If one or both of these connections is not operating properly, the system moves to a state 94 where a fault handling process is executed. As is the case with the other faults detected on the locomotive by the on board monitor, faults associated with the locomotive communications system 60 are logged into the operations log. Also, the communication system controller 62 tracks the number of consecutive fault occurrences, which is also included in the operations log. On a predetermined schedule, the operations log is downloaded to the monitoring and diagnostic service center 64. In addition to logging them into the operational log, certain conditions or faults associated with the locomotive communications 60 are also displayed to the locomotive operator. Each communication system fault has an associated reset strategy, which is a sequence of events to clear the fault or confirm that fault condition continues to exist.

The normal operational state of the locomotive communication system 60 is indicated by a state 96 in FIG. 3. When an incoming call is received an answer and download state 98 is activated, the call is answered and information is transferred between the locomotive communication system 60 and the monitoring and diagnostic service center 64. As discussed above, the information downloaded to the MDSC 64 includes operational parametric data, and data related to fault conditions and anomalous situations aboard the locomotive. The data uploaded to the locomotive includes software reconfiguration information. For example, the MDSC may issue a command to reconfigure a specific software application to increase the frequency at which a certain locomotive operational parameter is measured by the onward monitor. When the data transfer ends, the system returns to the operational state 96.

Prior to answering a call at the answer and download state 98 discussed above, the communications system controller 62 first determines whether the main locomotive controller switch is 64 closed by examining the signal on the status line shown in FIG. 2. If the status signal indicates that the controller switch is open, the call is not answered and the system returns to the operational state 96.

The call home state is identified by a reference character 100 in FIG. 3. As discussed in detail in the onward monitor patent application referred to above, certain locomotive faults require an immediate call back to the monitoring and diagnostic service center 64 so that information related to the fault can be immediately downloaded to the MDSC 64. When such a fault occurs, the call home state 100 is activated, but only if there are no incoming calls (state 98) and the main locomotive switch 64 is closed. That is, incoming calls at the state 98 are given a higher priority than the outgoing calls at the state 100. If the first call home is unsuccessful because, for example, the locomotive communication system 60 cannot establish a communications link with the monitor and diagnostic service center 64, then the call home is terminated and retried after a predetermined wait period has expired. The locomotive communication system 60 is programmed to execute a predetermined number of retries before discontinuing the call home associated with that fault. This feature of waiting a predetermined number of minutes before making the next call home and limiting the number of calls home allows the locomotive communication system 60 to be available for answering possible incoming calls. The number of retries, and the retry period can be remotely configured from the MDSC, thus providing a way of continually optimizing the communications system without a major software upgrade. All call home events (both successful and failed attempts) are recorded in the operational log. In the event the call home attempt is terminated unsuccessfully after the predetermined number of attempts have been made, the operations log is so notated and the information that was to have been downloaded is also recorded in the operations log. The operations log contents will be downloaded to the MDSC 64 during the next scheduled download. After the call home has ended or if is determined that the main locomotive switch 64 is open, the system moves from the call home state 100 to the operational state 96.

Figure 4:
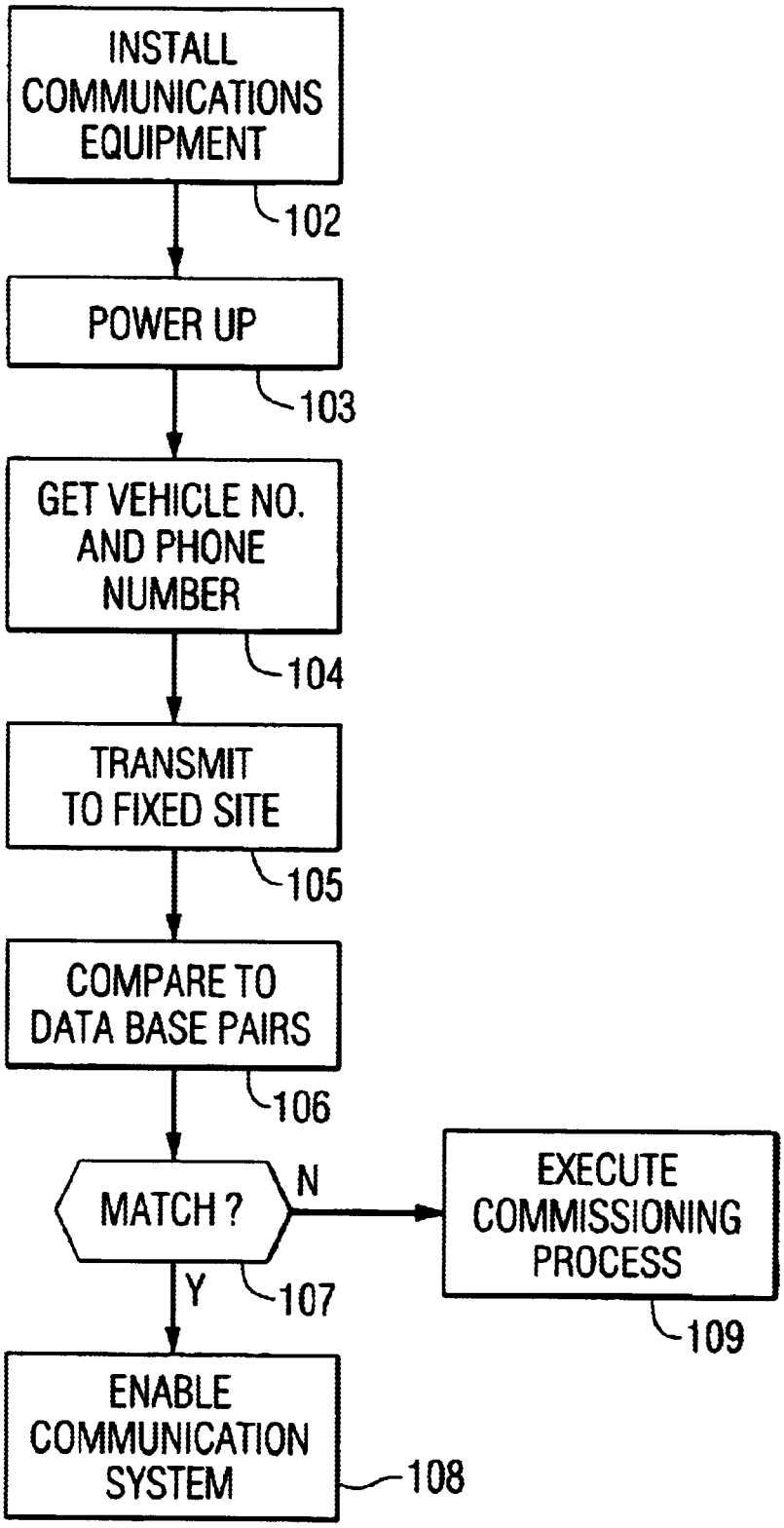
FIG. 4 is a flow chart illustrating another embodiment of the present invention.

In another related embodiment of the present invention, a communications system commissioning process can be performed as shown in FIG. 4. The communications equipment is installed in a vehicle at a step 102 and powered up at a step 103. At a step 104, the vehicle locomotive road number and the phone number of the communications system are retrieved and transmitted to the fixed site at a step 105. In one embodiment of the present invention, the fixed site can be a monitoring and diagnostic service center, or a dispatching center, where the remote computer is located. At the remote site, the vehicle number and phone number pair is used to search a database to find a matching vehicle number/phone number pair. This is accomplished at a step 106. A decision step 107 determines whether a match was located. A communications system is enabled at a step 108 if the transmitted vehicle number/phone number pair matched one of the entries in the database. If a match was not found, then the system has not been properly commissioned and a commissioning algorithm 10 (FIGS. 1A and 1B) must be executed. This step is illustrated at a step 109.

The present invention further includes a feature for ensuring that RF transmissions are not transmitted from nor received while maintenance personnel are servicing equipment in the vicinity of the antenna 72. It can be seen from FIG. 2 that the communications system controller 62 receives power independent of the main locomotive switch 64 status. That is, whether the main locomotive switch 64 is open or closed, power is supplied to the communication system controller 62. The communication system controller 62 is independently supplied with power to allow the controlled shut down of the communications system controller 62 and the onward monitor 69. Certain fault related and communications information must be retained by the onward monitor 69 and the locomotive communications system 60, even after power has been removed. To safely store this information, the onward monitor and the locomotive communications system 60 must therefore execute a controlled shutdown process. In the event the locomotive communications system 60 and the onward monitor are abruptly shut down, for instance, by opening of the main locomotive controller switch 64, valuable information may be lost due to a system fault.

Maintenance personnel are instructed to open the main locomotive controller switch 64 before beginning maintenance work near the antenna 72. The "open" status signal causes the communications system controller 62 to disable the receiver/transmitter 70. But because the communications system controller 62 is powered independently from the main locomotive controller switch 64, power will be present to activate the communications system 60 if the "open" signal fails to disable the communications system controller 62 or if the status signal "closed" hangs in that state when in fact the switch is open. Therefore, a redundant control scheme is utilized to provide a higher degree of safety. In the absence of the redundant scheme, the communications system controller system 62 would rely upon the status signal input thereto, and activate the receiver/transmitter 70 whenever the status signal indicates that the main locomotive controller switch 64 is closed. The redundant scheme assumes that the main locomotive controller switch 64 is closed only when the status signal indicates closure and when either the locomotive controller 66 or the locomotive controller 68 is in an active state. The receiver/transmitter 70 will be activated only when these conditions are both true.

Figure 5:
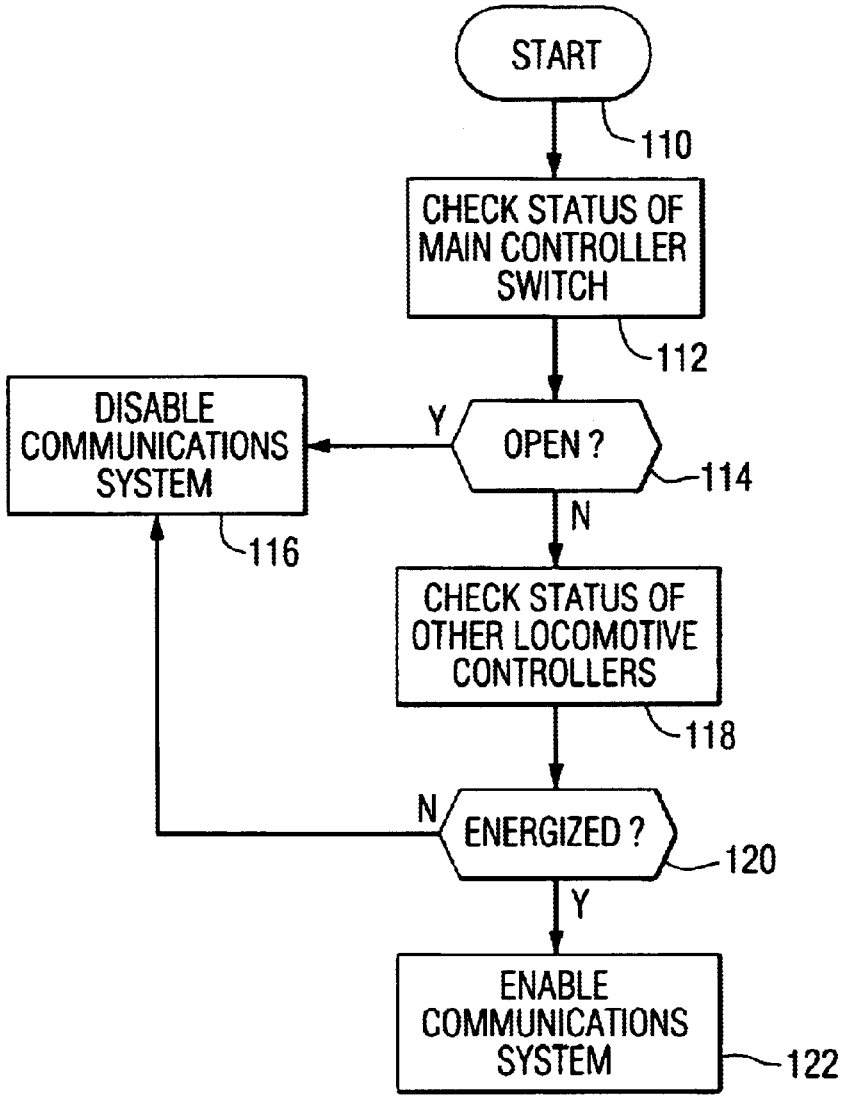
FIG. 5 is a flow chart illustrating the process for enabling the communications system of FIG. 2.

FIG. 5 depicts a flow chart of another embodiment for enabling the communications system 60, especially with regard to the RF protection feature. The process begins at a start step 110 and continues to a step 112 where the status of the main locomotive controller switch 64 is checked. The status is determined at a decision step 114. If the main locomotive controller switch 64 is open, processing proceeds to a step 116 where the communications system 60 is disabled. If the main locomotive controller switch 64 is closed, processing moves to a step 118 where one or more of the other locomotive controllers (for example, locomotive controllers 66 and 68) are checked to determine whether they are receiving power. If the other locomotive controllers are energized, as determined at a decision step 120, then the communications system is enabled at a step 122. If one or more of the other locomotive controllers are not energized, then processing proceeds back to the step 116 where the communications system is disabled.

While the invention has been described with reference to a preferred embodiment, it will be understood by those skilled in the art that various changes may be made and equivalent elements may be substituted for the elements thereof without departing from the scope of the invention. In addition, modifications may be made to adapt a particular situation to the teachings of the present invention without departing from the essential scope thereof. Therefore, it is intended that the invention not be limited to the particular embodiment disclosed as the best mode contemplated for carrying out this invention but that the invention will include all embodiments falling within the scope of the appended claims.

What is claimed is:

1. A method for enabling a communications system at a first site to permit communications with a second site, wherein the first site has a unique identification number and wherein the communications system has a unique phone number, and wherein operational data collected at the first site is transmitted to the second site said method comprising:

(a) retrieving the identification number and the phone number at the first site;

(b) transmitting the identification number and the phone number to the second site;

(c) at the second site, consulting a data base of identification number/phone number pairs;

(d) determining whether the transmitted identification number/phone number pair matches an entry in the data base;

(e) permitting communications between the first site and the second site in response to a match;

(f) receiving operational data at the second site;

(g) determining the phone number associated with the received operational data; and (h) attributing the received operational data to the unique identification number of the first site in response to the identification number/phone number pair match.

2. The method of claim 1 wherein the first site is a mobile unit and the second site is a fixed site.

3. The method of claim 2 wherein the mobile unit is a railroad locomotive and wherein the unique identification number is the locomotive road number.

4. A method for enabling a communications system on a mobile unit to permit communications with a fixed site, wherein the communications system includes a controller having a unique controller identification number and a unique phone number and wherein the mobile unit has a unique mobile identification number, said method comprising:

(a) retrieving the mobile identification number and the controller identification number;

(b) comparing the mobile identification number with the controller identification number;

(c) permitting communications between the mobile unit and the fixed site in response to a match between the controller identification number and the mobile identification number;

(d) in the event there is not a match, establishing a link to the fixed site via the communications system;

(e) providing the mobile identification number to the fixed site over the communications link;

(f) at the fixed site, determining the phone number of the communications system;

(g) storing the mobile identification number/phone number pair at the fixed site;

(h) terminating the communications link;

(i) calling the mobile unit from the fixed site using the stored phone number; and (j) activating a communications link between the mobile unit and the fixed site if the call from the fixed site is answered.

5. The method of claim 4 further including a step (k) setting the controller identification number equal to the mobile identification number at the mobile unit.

6. The method of claim 4 wherein the first site is a mobile unit and the second site is a fixed site.

7. The method of claim 6 wherein the mobile unit is a railroad locomotive and wherein the unique identification number is the locomotive road number.

8. An article of manufacture comprising:

a computer program product comprising a computer-usable medium having a computer-readable code therein for activating a communications system between a mobile unit and a fixed site, wherein the communications system includes a communication controller having a unique controller identification number and a unique phone number and wherein the mobile unit has a unique mobile identification number, the computer-readable code in the article of manufacturing comprising:

a computer-readable program code module for retrieving the mobile identification number and the controller identification number;

a computer-readable program code module for comparing the mobile identification number with the controller identification number;

a computer-readable program code module for permitting communications between the mobile unit and the fixed site in response to a match between the controller identification number and the mobile identification number, a computer-readable program code module for contacting the fixed site in the event there is not a match;

a computer-readable program code module for providing the mobile identification number to the fixed site;

a computer-readable program code module for determining the phone number of the communications system from the fixed site;

a computer-readable program code module for storing the mobile identification number/phone number pair at the fixed site;

a computer-readable program code module for terminating the communications link between the mobile unit and the fixed site;

a computer-readable program code module for calling the mobile unit from the fixed site using the stored phone number;

a computer-readable program code module for activating a communications link between the mobile unit and the fixed site if the call from the fixed site is answered.

9. The article of manufacture of claim 8 including a computer-readable program code module for setting the controller identification number equal to the mobile identification number on the mobile unit.

* * * * *